US009232597B2

(12) United States Patent
Ueda et al.

(10) Patent No.: US 9,232,597 B2
(45) Date of Patent: Jan. 5, 2016

(54) LIGHTING DEVICE AND LIGHTING SYSTEM WITH THE SAME

(71) Applicant: Panasonic Intellectual Property Management Co., Ltd., Osaka (JP)

(72) Inventors: Daisuke Ueda, Osaka (JP); Hiroshi Kido, Osaka (JP); Akinori Hiramatu, Nara (JP); Junichi Hasegawa, Osaka (JP); Shigeru Ido, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/619,645

(22) Filed: Feb. 11, 2015

(65) Prior Publication Data

US 2015/0250036 A1 Sep. 3, 2015

(30) Foreign Application Priority Data

Feb. 28, 2014 (JP) ..... 2014-039140

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.

CPC ..... *H05B 33/0848* (2013.01); *H05B 33/089* (2013.01)

(58) Field of Classification Search

None

See application file for complete search history.

(56) References Cited

U.S. PATENT DOCUMENTS

| | | | | |
|---|---|---|---|---|
| 7,332,875 | B2 * | 2/2008 | Toyota et al. | 315/291 |
| 2005/0062445 | A1 | 3/2005 | Toyota et al. | |
| 2011/0204823 | A1 | 8/2011 | Mizukawa et al. | |
| 2011/0260648 | A1 | 10/2011 | Hamamoto et al. | |
| 2012/0319602 | A1 | 12/2012 | Naruo et al. | |
| 2014/0097764 | A1 * | 4/2014 | Ueda et al. | 315/200 R |

FOREIGN PATENT DOCUMENTS

| | | | |
|---|---|---|---|
| JP | 2003-308988 | A | 10/2003 |
| JP | 2005-093196 | A | 4/2005 |
| JP | 2011-171230 | A | 9/2011 |
| JP | 2011-181295 | A | 9/2011 |
| JP | 2011-233637 | A | 11/2011 |
| JP | 2013-004280 | A | 1/2013 |

* cited by examiner

*Primary Examiner* — Anh Tran

(74) *Attorney, Agent, or Firm* — Renner, Otto, Boisselle & Sklar, LLP

(57) ABSTRACT

A lighting device includes: first and second power feed terminals between which a light source of a light source device is configured to be electrically connected; a power supply circuit having output ends electrically connected respectively to the first and second power feed terminals and configured to output a DC power across the first and second power feed terminals; a control circuit configured to control the power supply circuit; and at least one identifying terminal for identifying a rated current of a light source. The control circuit is configured to identify a rated current of a light source connected between the first and second power feed terminals by detecting whether the identifying terminal is in floating state or not, and to control the power supply circuit so as to supply a current corresponding to the identified rated current through the first and second power feed terminals.

6 Claims, 5 Drawing Sheets

LIGHTING DEVICE AND LIGHTING SYSTEM WITH THE SAME

CROSS-REFERENCE TO RELATED APPLICATIONS

The application is based upon and claims the benefit of priority of Japanese Patent Application No. 2014-039140, filed on Feb. 28, 2014, the entire contents of which are incorporated herein by reference.

TECHNICAL FIELD

The invention relates to a lighting device and a lighting system with the lighting device.

BACKGROUND ART

JP2005-93196A discloses a conventional example of a lighting device which is configured to be connected to a light source device including a light-emitting device (such as a light-emitting diode) and to light the light-emitting device of the light source device. The lighting device of the conventional example is configured to be connected to a light source device selected from predetermined two or more light source devices that have different rated currents.

In the conventional example, each of the two or more light source devices is provided with a resistor connected in parallel to a light-emitting device thereof, and the resistors of the two or more light source devices have different impedance (different resistance values) in accordance with the rated currents of the light sources.

Also, the lighting device of the conventional example is configured, before starting lighting a light-emitting device of a light source device connected thereto, to supply the light source device with a small current so as not to light the light-emitting device, and to measure a voltage drop in the light source device (i.e., measure a voltage drop across a resistor of the light source device). The lighting device is configured to identify a rated current of the light source device connected to the lighting device based on the measured voltage drop, and to supply the light source device with the identified rated current.

In a lighting device which is configured to identify a light source device connected thereto based on a voltage drop across a resistor (i.e., based on an impedance of the resistor) as in the conventional example, there is however a problem that the lighting device is liable to make wrong identification of a connected light source device owing to noise and/or fluctuation in impedance of the resistor caused by temperature fluctuation.

SUMMARY

The invention has been achieved in view of the above circumstances, and an object thereof is to provide a lighting device capable of suppressing occurrence of wrong identification of a light source device, and a lighting system including the lighting device.

A lighting device in the invention is configured to be connected to a light source device selected from predetermined two or more light source devices. The lighting device includes: first and second power feed terminals between which a light source of each light source device is configured to be electrically connected; a power supply circuit that has high potential side and low potential side output ends electrically connected respectively to the first and second power feed terminals and is configured to output a DC power across the first and second power feed terminals through the high potential side and low potential side output ends; a control circuit configured to control the power supply circuit; and at least one identifying terminal for identifying a rated current of a light source of each light source device. The control circuit is configured to identify (determine) a rated current of a light source connected between the first and second power feed terminals by detecting whether the identifying terminal is in floating state or not, and to control the power supply circuit so as to supply a current corresponding to the identified rated current to the light source through the first and second power feed terminals.

A lighting system of the invention includes the lighting device and the two or more light source devices configured to be selectively connected to the lighting device. The two or more light source devices includes at least a first light source device and a second light source device. Each of the first and second light source devices includes: a first power receiving terminal configured to be electrically connected to the first power feed terminal; a second power receiving terminal configured to be electrically connected to the second power feed terminal; and a light source electrically connected between its own first and second power receiving terminals. A rated current of a light source of the first light source device is different from a rated current of a light source of the second light source. The identifying terminal of the lighting device includes first and second identifying terminals. The second light source device includes first and second notifying terminals, where the first notifying terminal is electrically connected to its own second power receiving terminal and configured to be electrically connected to the first identifying terminal of the lighting device, and the second notifying terminal is electrically connected to its own second power receiving terminal and configured to be electrically connected to the second identifying terminal of the lighting device. The first light source device includes a second notifying terminal electrically connected to its own second power receiving terminal and configured to be electrically connected to the second identifying terminal of the lighting device. The control circuit of the lighting device is configured to detect that the first identifying terminal is not in floating state when the first identifying terminal is electrically connected to a first notifying terminal, and to detect that the second identifying terminal is not in floating state when the second identifying terminal is electrically connected to a second notifying terminal. The control circuit of the lighting device is configured to control the power supply circuit so as to supply a current corresponding to a rated current of the light source of the second light source device through the first and second power feeding terminals when the first and second identifying terminals are not in floating state, and to control the power supply circuit so as to supply a current corresponding to a rated current of the light source of the first light source device through the first and second power feeding terminals when the first identifying terminal is in floating state and the second identifying terminal is not in floating state.

BRIEF DESCRIPTION OF THE DRAWINGS

The figures depict one or more implementation in accordance with the present teaching, by way of example only, not by way of limitations. In the figures, like reference numerals refer to the same or similar elements, where.

DETAILED DESCRIPTION

Figure 1:
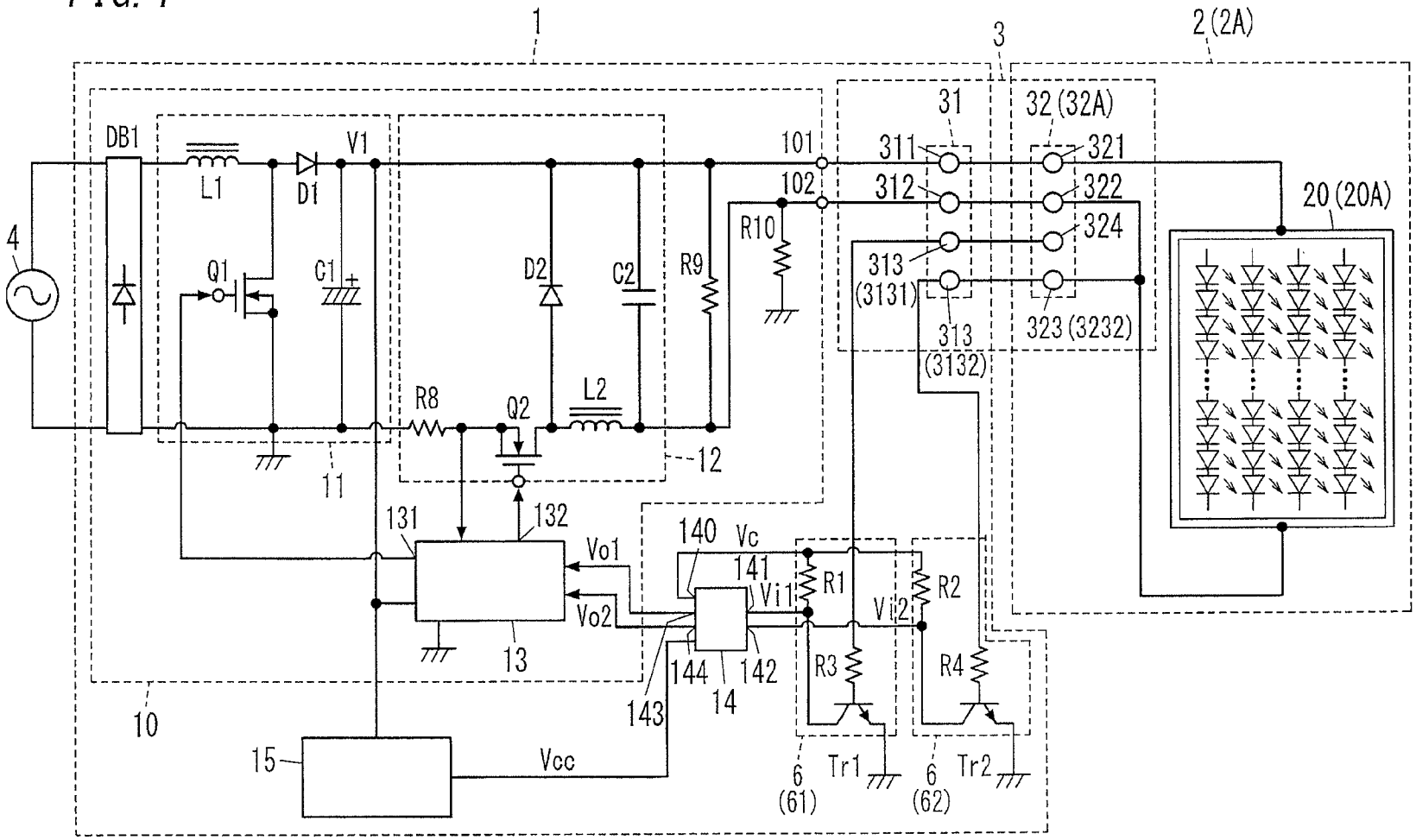
FIG. 1 is a circuit diagram of a lighting device and a light source device according to an embodiment.

A lighting device 1 of the present embodiment includes a pair of power feed terminals 311 and 312, a power supply circuit 10, a control circuit 14, and at least one identifying terminal 313. The pair of power feed terminals 311 and 312 is configured to be electrically connected to a light source 20 included in a light source device 2 The power supply circuit 10 is configured to output a DC power to the power feed terminals 311 and 312. The control circuit 14 is configured to control the power supply circuit 10. The at least one identifying terminal 313 is configured to be electrically connected to a notifying terminal 323 with which the light source device 2 is provided according to a rated current of the light source 20. The control circuit 14 is configured to identify the rated current of the light source 20 by detecting whether the identifying terminal 313 is in floating state or not, and to control the power circuit 10 so as to supply a current corresponding to the identified rated current through the power feed terminals 311 and 312.

In the lighting device 1, preferably, the identifying terminal 313 includes two or more identifying terminals 313(3131) and 313(3132).

In the lighting device 1, preferably, either one of the power feed terminals 311 and 312 is grounded.

A lighting system of the embodiment includes the lighting device 1 and two or more light source devices 2 configured to be selectively connected to the lighting device 1. Each of the light source devices 2 includes power receiving terminals 321 and 322 configured to be electrically connected to the power feed terminals 311 and 312 one-by-one; a light source 20 electrically connected between the power receiving terminals 321 and 322; and at least one notifying terminal 323 electrically connected to one (322) of the receiving terminals. In the two or more light source devices 2, identifying terminals 313 to be electrically connected to the notifying terminals 323 differ depending on rated currents of their light sources 20.

Hereinafter, a lighting system and a lighting device of the embodiment will be explained with reference to attached drawings.

As shown in FIG. 1, the lighting system of the embodiment includes the lighting device 1 and the two or more light source devices 2 configured to be selectively connected to the lighting device 1. That is, the lighting device 1 of the embodiment is configured to be connected to a light source device (2) selected from predetermined two or more light source devices 2.

The lighting device 1 includes the power supply circuit 10 configured to output a DC power. The power supply circuit 10 includes a high potential side output end 101 and a low potential side output end 102, and is configured to output the DC power through the output ends 101 and 102.

The power supply circuit 10 includes a diode bridge DB1, a boost converter 11, a buck converter 12, and a drive circuit 13 configured to operate the boost converter 11 and the buck converter 12. The drive circuit 13 is formed of a micro computer, for example.

The diode bridge DB1 is configured to full-wave rectify (commutate) an AC power supplied from an external AC power supply 4. The diode bridge DB1 has a low potential side output end which is grounded.

The boost converter 11 is configured to convert a DC power (a pulsating power) supplied from the diode bridge DB1 into a DC power of a predetermined voltage. As shown in FIG. 1, the boost converter 11 includes a first inductor L1, a first diode D1, a capacitor (a first output capacitor) C1 and a first switching device Q1. The first inductor L1 has a first end electrically connected to a high potential side output end of the diode bridge DB1, and a second end electrically connected to an anode of the first diode D1. The first output capacitor C1 is electrically connected between a cathode of the first diode D1 and the low potential side output end of the diode bridge DB1 (i.e., ground). The first switching device Q1 is electrically connected between the anode of the first diode D1 and the low potential side output end of the diode bridge DB1. Specifically, the first switching device Q1 has a first end (a drain) electrically connected to a junction of the first inductor L1 and the anode of the first diode D1, and a second end (a source) electrically connected to the low potential side output end of the diode bridge DB1. The first output capacitor C1 has a first end which is electrically connected to the cathode of the first diode D1 and corresponds to a high potential side output end of the boost converter 11, and a second end which is electrically connected to the low potential side output end of the diode bridge DB1 and corresponds to a low potential side output end of the boost converter 11. That is, a voltage across the first output capacitor C1 corresponds to an output voltage V1 of the boost converter 11.

The drive circuit 13 has an output terminal (a first output terminal) 131 electrically connected to a control end (a gate) of the first switching device Q1. The drive circuit 13 is configured to periodically turn on and off the first switching device Q1 by switching a level of an output voltage of the first output terminal 131. The drive circuit 13 is configured to perform a constant voltage control so as to keep the output voltage V1 of the boost converter 11 at a target voltage. Specifically, the drive circuit 13 is configured to measure the output voltage V1 of the boost converter 11, and to adjust an on-duty ratio of the first switching device Q1 properly in response to the measured output voltage V1, thereby keeping the output voltage V1 of the boost converter 11 at the target voltage. The boost converter 11 is also called a PFC (Power factor correction) circuit since it has a function configured to increase the power factor close to 100%.

The buck converter 12 is configured to step down the DC voltage supplied from the boost converter 11. As shown in FIG. 1, the buck converter 12 includes a second diode D2, a second switching device (a depletion MOSFET) Q2, a resistor R8, a capacitor (a second output capacitor) C2 and a second inductor L2. A cathode of the second diode D2 is electrically connected to the high potential side output end of the boost converter 11. A series circuit of the second switching device Q2 and the resistor R8 is electrically connected between an anode of the second diode D2 and the low potential side output end of the boost converter 11 (the ground). Specifically, the second switching device Q2 has a first end (a drain) electrically connected to a junction of the second inductor L2 and the anode of the second diode D2, and a second end (a source) electrically connected to the resistor R8. A series circuit of the second output capacitor C2 and the second inductor L2 is connected between both ends of the second diode D2. The second output capacitor C2 has a first end which is electrically connected to the cathode of the second diode D2 and corresponds to a high potential side output end of the buck converter 12, and a second end which is electrically connected to the second inductor L2 and corresponds to a low potential side output end of the buck converter 12. That is, a voltage across the second output capacitor C2 corresponds to an output voltage of the buck converter 12.

The drive circuit 13 has an output terminal (a second output terminal) 132 electrically connected to a control end (a gate) of the second switching device Q2. The drive circuit 13 is configured to measure a current flowing through the second switching device Q2 with a resistor R8 as a shunt resistor, which is connected in series to the second switching device Q2. The drive circuit 13 is configured to perform a constant current control so as to keep the output current of the buck converter 12 at a target current. That is, the drive circuit 13 is configured to turn on and off the second switching device Q2 by switching a level of an output voltage of the second output terminal 132 at appropriate timings based on the current measured with the resistor R8, thereby keeping the output current of the buck converter 12 at the target current.

Also, a resistor R9 is connected between both ends of the second output capacitor C2. The low potential side output end of the buck converter 12 is grounded via a resistor R10. The high potential side output end 101 of the power supply circuit 10 is electrically connected to the high potential side output end of the buck converter 12. The low potential side output end 102 of the power supply circuit 10 is electrically connected to the low potential side output end of the buck converter 12.

The lighting device 1 of the embodiment further includes a control circuit 14 and a control power supply circuit 15. The control circuit 14 may be a micro computer, and is configured to control the drive circuit 13 of the power supply circuit 10. The control power supply circuit 15 is configured to be supplied with electric power from the boost converter 11, and to generate electric power for the control circuit 14.

Each of the light source devices 2 is configured to be electrically connected to the lighting device 1 via a connector pair 3 having a known structure. The connector pair 3 includes a supply side connector 31 provided in the lighting device 1 and a load side connector 32 provided in each light source device 2. The load side connector 32 is configured to be detachably connected to the supply side connector 31 by, for example, engagement with the supply side connector 31.

The supply side connector 31 includes a pair of power feed terminals 311 and 312 electrically connected to the output ends of the buck converter 12 (i.e., the output ends 101 and 102 of the power supply circuit 10) one-by-one. Specifically, the supply side connector 31 includes a first power feed terminal 311 electrically connected to the high potential side output end 101 of the power supply circuit 10, and a second power feed terminal 312 electrically connected to the low potential side output end 102 of the power supply circuit 10.

The load side connector 32 includes a pair of power receiving terminals 321 and 322 configured to come into contact with and make electrical connection with the pair of pair of power feed terminals 311 and 312 one-by-one when the load side connector 32 is connected to the supply side connector 31. Specifically, the load side connector 32 includes first and second power receiving terminals 321 and 322 configured to be electrically connected respectively to the first and second power feed terminals 311 and 312 when the load side connector 32 is connected to the supply side connector 31. Each of the light source devices 2 includes a light source 20, which is composed of a light-emitting diode array and which has an anode electrically connected to the first power receiving terminal 321 (as a high potential side) and a cathode electrically connected to the second power receiving terminal 322 (as a low potential side). That is, in each light source device 2, a light source 20 is electrically connected between first and second power receiving terminals 321 and 322. Rated currents of light sources 20 of the light source devices 2 are different from each other. The difference in the rated currents of the light sources 20 may be caused by, for example: the difference in properties of the light-emitting diodes that form the light source 20, such as the emission color, the light flux, and the like; and the difference in the number of LED circuits connected in parallel in the light source 20, where each of the LED circuits may be series-connected light-emitting diodes or one light-emitting diode. The light source 20 is not limited to the light-emitting diode array, and may be one light emitting diode or another known light source such as an organic EL device.

The supply side connector 31 further includes at least one identifying terminal 313. In the lighting device 1 of the example of FIG. 1, the supply side connector 31 includes two identifying terminals 313 (a first identifying terminal 3131 and a second identifying terminal 3132). The lighting device 1 further includes NPN transistors Tr1 and Tr2 (a first transistor Tr1 and a second transistor Tr2) of which the number (two, in the example of FIG. 1) is the same as that of identifying terminals 313. The transistor Tr1 has a base which is electrically connected to the identifying terminal 3131 via a resistor R3, and an emitter which is grounded. Also, the transistor Tr2 has a base which is electrically connected to the identifying terminal 3132 via a resistor R4, and an emitter which is grounded. The control circuit 14 has a constant voltage terminal 140 which is electrically connected to collectors of the transistors Tr1 and Tr2 via resistors R1 and R2, respectively, and is configured to output a constant voltage Vc. The control circuit 14 further has input terminals 141 and 142 (a first input terminal 141 and a second input terminal 142) of which the number (two, in the example of FIG. 1) is the same as that of identifying terminals 313. The input terminals 141 and 142 are electrically connected to the collectors of the transistors Tr1 and Tr2, respectively.

Each of the transistors Tr1 and Tr2 functions as a normally-open switch. When no voltage is applied to the base of the first transistor Tr1, the first transistor Tr1 is in off-state. In this state, an input voltage Vi1 at the first input terminal 141 is at high (H) level that substantially corresponds to the constant voltage Vc outputted from the constant voltage terminal 140. On the other hand, when a predetermined voltage or more is applied to the base of the first transistor Tr1, the first transistor Tr1 is in on-state. In this state, an electric current flows from the constant voltage terminal 140 to the ground through the resistor R1 and the first transistor Tr1, and thus the input voltage Vi1 at the first input terminal 141 is at low (L) level. Similarly, an input voltage Vi2 at the second input terminal 142 is at H level when no voltage is applied to the base of the second transistor Tr2, and the input voltage Vi2 at the second input terminal 142 is at L level when a predetermined voltage or more is applied to the base of the second transistor Tr2.

In other words, the lighting device 1 includes at least one potential change detection circuit 6 which is electrically connected individually to at least one identifying terminal 313 and which is configured to detect a change in potential at a corresponding identifying terminal 313. The control circuit 14 is configured to detect whether the identifying terminal 313 is in floating state or not based on the change in potential at the identifying terminal 313 detected with the potential change detection circuit 6. The potential change detection circuit 6 of the embodiment includes a switch (the transistor Tr1 (Tr2) and the resistor R3 (R4)) configured to be turned on or off depending on the potential at the corresponding identifying terminal 313, and the resistor R1 (R2) configured to notify the control circuit 14 of a change in state of the switch. The switch is configured to be turned off when the corresponding identifying terminal 313 is in floating state, and turned on when the corresponding identifying terminal 313 is not in floating state.

In the example of FIG. 1, the lighting device 1 includes a first potential change detection circuit 6(61) and a second potential change detection circuit 6(62). The first potential change detection circuit 61 is electrically connected to the first identifying terminal 3131 and configured to detect a change in potential at the first identifying terminal 3131. The second potential change detection circuit 62 is electrically connected to the second identifying terminal 3132 and configured to detect a change in potential at the second identifying terminal 3132. The control circuit 14 is configured to detect whether the first identifying terminal 3131 is in floating state or not based on the change in potential at the first identifying terminal 3131 detected with the first potential change detection circuit 61, and also to detect whether the second identifying terminal 3132 is in floating state or not based on the change in potential at the second identifying terminal 3132 detected with the second potential change detection circuit 62.

On the other hand, in the embodiment, a load side connector 32 of each light source device 2 includes one or more notifying terminals 323 each of which is electrically connected to the second power receiving terminal 322 and is configured to come into contact with and make electrical connection with a corresponding identifying terminal 313. In the two or more light source devices 2, arrangement and/or the number of notifying terminals 323 differ according to the rated current of light source 20. When an identifying terminal 313 comes into contact with and makes electrical connection with (namely, is electrically connected with) a notifying terminal 323, it (the identifying terminal) is also electrically connected to the second power receiving terminal 322 through the notifying terminal 323 and also to the second power feed terminal 312 that is in contact with and makes electrical connection with the second power receiving terminal 322.

For example, in a light source device 2 shown in FIG. 1 (hereinafter, referred to as "a first light source device 2A"), only one identifying terminal 313 (the second identifying terminal 3132) of the lighting device 1 is to be connected to a second power receiving terminal 322 through a notifying terminal 323(3232). In a light source device 2 shown in FIG. 2 (hereinafter, referred to as "a second light source device 2B"), both of identifying terminals 313 (the first identifying terminal 3131 and the second identifying terminal 3132) of the lighting device 1 are to be connected to a second power receiving terminal 322 through respective notifying terminals 323(3231) and 323(3232). A rated current of a light source 20 (hereinafter, referred to as "a light source 20A") of the first light source device 2A differs from a rated current of a light source 20 (hereinafter, referred to as "a light source 20B") of the second light source device 2B.

In other words, the first light source device 2A has only one notifying terminal 323 (a second notifying terminal 3232) which is electrically connected to the second power receiving terminal 322 and is configured to be electrically connected to the identifying terminal 313 (the second identifying terminal 3132) of the lighting device 1. On the other hand, the second light source device 2B has two notifying terminals 323 (a first notifying terminal 3231 and a second notifying terminal 3232) which are electrically connected to the second power receiving terminal 322 and are configured to be electrically connected to the respective identifying terminals 313 (the first identifying terminal 3131 and the second identifying terminal 3132) of the lighting device 1.

Figure 2:
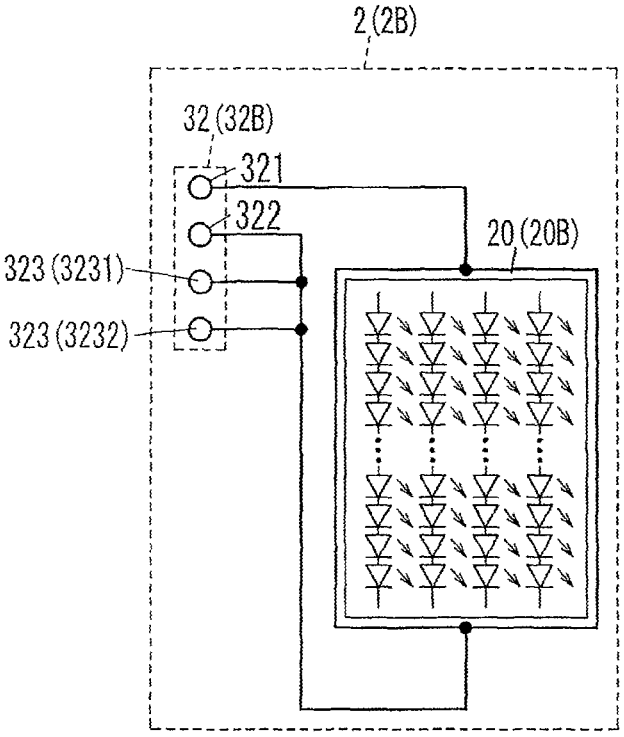
FIG. 2 is a circuit diagram of another light source device according to the embodiment.

For example, a light source device 2 provided with the light source 20A of which the rated current is 1 [A] has a structure shown in FIG. 1, and a light source device 2 provided with the light source 20B of which the rated current is 350 [mA] has a structure shown in FIG. 2.

In a light source device 2 of which the number of notifying terminals 323 is less than the number of identifying terminals 313 of the lighting device 1, as in the first light source device 2A shown in FIG. 1, a dummy terminal(s) 324 configured to be in contact with a corresponding identifying terminal(s) 313 is provided in substitution for a notifying terminal(s) 323. The dummy terminal 324 has the same structure as that of the notifying terminal 323, but is electrically isolated from the power receiving terminals 321 and 322. However, the dummy terminal 324 is optional. Note that a notifying terminal 323 may have such a structure that one notifying terminal 323 comes into contact with and makes electrical connection with two or more identifying terminals 313.

Figure 3:
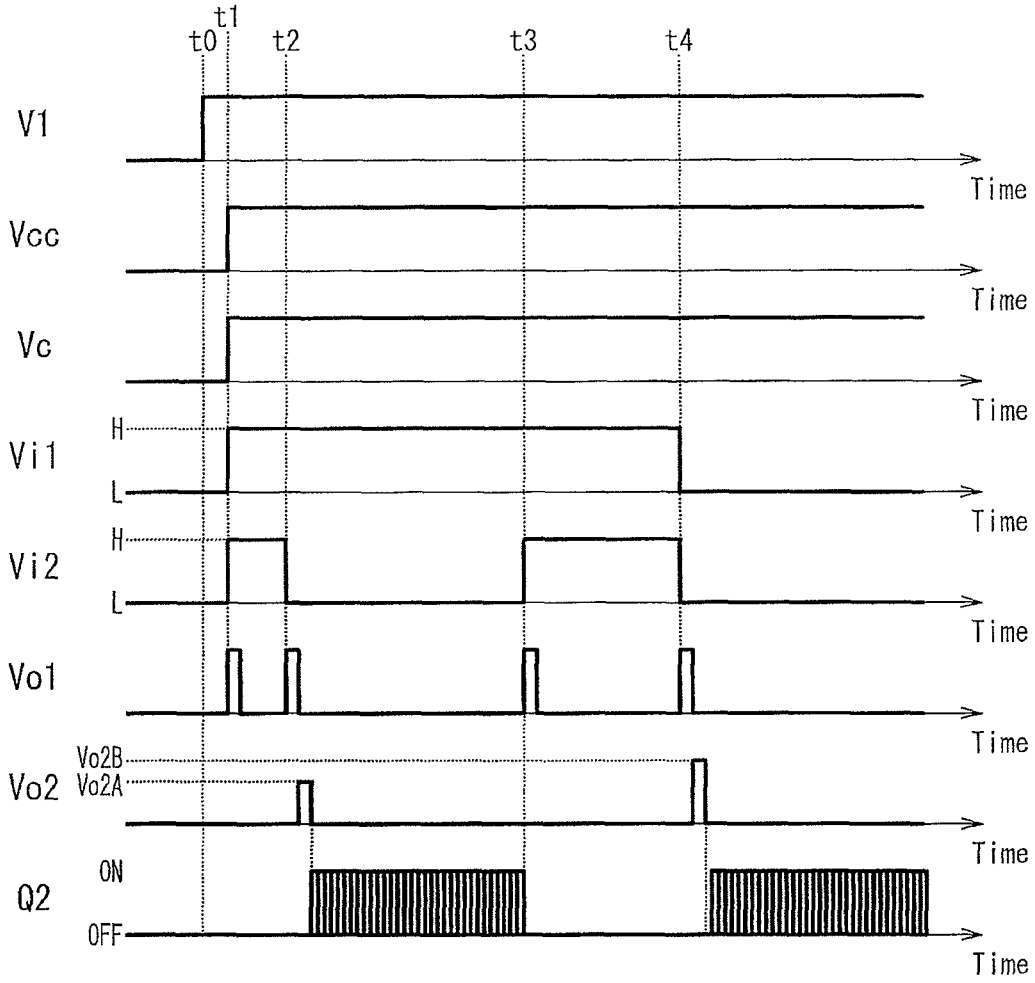
FIG. 3 is a view illustrating an operation of the lighting device according to the embodiment, where the two light source devices are attached to and detached from the lighting device in turn.

Hereinafter, an operation of the lighting system of the embodiment is described with reference to FIG. 3. In the example of FIG. 3: at a time point t0, the AC power supply 4 starts supplying electric power to the lighting device 1; at a time point t2, the first light source device 2A is connected to the lighting device 1; at a time point t3, the first light source device 2A is detached from the lighting device 1; and at a time point t4, the second light source device 2B is connected to the lighting device 1 (a rated current of a light source 20B of the second light source device 2B differs from a rated current of a light source 20A of the first light source device 2A).

When the lighting device 1 starts receiving electric power from the AC power supply 4, the output voltage V1 of the boost converter 11 increases, as shown at the time point t0 of FIG. 3. At the time point t0, the drive circuit 13 keeps the second switching device Q2 in off-state. At this time, a voltage (namely, a potential at the second power feed terminal 312) of the second power feed terminal 312 (which is at a low potential side) with respect to the ground corresponds to a divided voltage of the potential, with respect to the ground, of the high potential side output end of the boost converter 11 divided by the resistors R9 and R10. When the output voltage V1 of the boost converter 11 increases, the control power supply circuit 15 receives electric power from the boost converter 11 and then an output voltage Vcc of the control power supply circuit 15 also increases, as shown at the time point t1 of FIG. 3. The control circuit 14 then starts operating by use of electric power (the output voltage Vcc) supplied from the control power supply circuit 15, and starts outputting the constant voltage Vc from the constant voltage terminal 140. Note that the resistors R9 and R10 has such resistance values that a voltage across the power feed terminals 311 and 312 in a period of the second switching device Q2 being in off-state (i.e., in each period between the time points t0 and t2 and between the time points t3 and t4) is smaller than a smallest one of forward voltages of light sources 20 of the two or more light source devices 2.

When no load side connector 32 is connected to the supply side connector 31 (i.e., in each period between the time points t0 and t2 and between the time points t3 and t4), all of the identifying terminals 313 are in floating state. In this state, since all of the transistors Tr1 and Tr2 are in the off-state, each of the input voltages Vi1 and Vi2 at the input terminals 141 and 142 of the control circuit 14 is at H level that substantially corresponds to the constant voltage Vc.

When a load side connector 32 is connected to the supply side connector 31, as shown at each of time points t2 and t4 of FIG. 3, an identifying terminal(s) 313 comes into contact with and makes electrical connection with a corresponding notifying terminal(s) 323, and also is electrically connected to the second power feed terminal 312 through a circuit inside the light source device 2.

As described above, the voltage across the power feed terminals 311 and 312 is smaller than the smallest one of forward voltages of light sources 20 of the two or more light source devices 2 at this time point (at each of time points t2 and t4), and therefore a light source 20 of a connected light source device 2 cannot be lighted regardless of kinds of the light source device 2. Also, a transistor(s), out of the transistors Tr1 and Tr2, of which the base is connected to an identifying terminal 313 that is electrically connected to the second power feed terminal 312 is then turned on. Then, an input voltage(s) at an input terminal(s), out of the input terminals 141 and 142, connected to the turned on-transistor is at L level. In short, an input voltage(s) at an input terminal(s), out of the input terminals 141 and 142, corresponding to an identifying terminal(s) 313 coming into contact with and making electrical connection with a notifying terminal 323 (i.e., being not in floating state) is at L level.

On the other hand, an input voltage(s) at an input terminal (s), out of the input terminals 141 and 142, corresponding to an identifying terminal(s) 313 not coming into contact with a notifying terminal 323 (i.e., being in floating state) is kept at H level.

Accordingly, it is possible to detect whether the identifying terminal 313 is in floating state or not.

Specifically, as shown at the time point t2 of FIG. 3, the lighting device 1 is connected to the first light source device 2A (shown in FIG. 1) which has only one notifying terminal 323(3232) configured to come into contact with and make electrical connection with the second identifying terminal 3132, and accordingly the input voltage Vi2 at the input terminal 142 is at L level whereas the input voltage Vi1 at the input terminal 141 is kept at H level. At the time point t4 of FIG. 3, the lighting device 1 is connected to the second light source device 2B (shown in FIG. 2) which has two notifying terminals 323(3231) and 323(3232) configured to come into contact with and make electrical connection with the first and second identifying terminals 3131 and 3132 one-by-one, and accordingly the input voltages Vi1 and Vi2 at the input terminals 141 and 142 each is at L level.

Incidentally, the control circuit 14 includes a storage unit, and the storage unit stores a data table that represents a relationship between rated currents of light sources 20 of the two or more light source devices 2 and combination of levels of the input voltages Vi1 and Vi2 at the input terminals 141 and 142. For example, as exemplified in Table 1 below, in the data table of the embodiment, a rated current of 1 [A] is associated with a combination of levels in which the input voltage Vi1 is at H level and the input voltage Vi1 is at L level. Also, a rated current of 350 [mA] is associated with a combination of levels in which the input voltage Vi1 is at L level and the input voltage Vi1 is at L level. The control circuit 14 is configured to compare the combination of levels of the input voltages Vi1 and Vi2 with the data table, thereby identifying a rated current of a light source 20 of a light source device 2 connected to the lighting device 1.

TABLE 1

| Rated Current | Level of Input Voltage Vi1 | Level of Input Voltage Vi2 |
|---|---|---|
| 1 [A] | H | L |
| 350 [mA] | L | L |
| ... | ... | ... |

When identified is the rated current of the light source 20 of the light source device 2, the control circuit 14 informs the drive circuit 13 of the identified rated current.

Specifically, the control circuit 14 has two output terminals 143 and 144 (a first output terminal 143 and a second output terminal 144) which are electrically connected to different input terminals of the drive circuit 13, for example.

The control circuit 14 is configured to output, from the first output terminal 143, a pulse signal Vo1 when detecting that one of the light source devices 2 is attached to or detached from the lighting device 1 (namely, detecting attachment and detachment of a load side connector 32 to and from the supply side connector 31).

For example, as shown at each of time points t2 and t4 of FIG. 3, the control circuit 14 is configured to detect the attachment of a light source device 2 when any one of the input voltages at the input terminals 141 and 142 is at L level (namely, any one of the identifying terminals 3131 and 3132 is not in floating state). For example, as shown at the time point t3 of FIG. 3, the control circuit 14 is configured to detect the detachment of a light source device 2 when all of the input voltages at the input terminals 141 and 142 are at H level (namely, all of the identifying terminals 3131 and 3132 are in floating state).

The control circuit 14 is also configured, when identified is a rated current of a light source 20 of a light source device 2, to output, from the second output terminal 144, a pulse signal Vo1 of which amplitude (voltage value) represents the identified rated current.

In the example of FIG. 3, the control circuit 14 identifies that the first light source device 2A is connected to the lighting device 1 at the time point t2, and then outputs a pulse signal Vo1 of which amplitude (Vo2A) represents the rated current of the light source 20A of the first light source device 2A. The control circuit 14 also identifies that the second light source device 2B is connected to the lighting device 1 at the time point t4, and then outputs a pulse signal Vo1 of which amplitude (Vo2B) represents the rated current of the light source 20B of the second light source device 2B.

Therefore, when a light source device 2 is connected to the lighting device 1 (at each of time points t2 and t4 of FIG. 3), the control circuit 14 outputs the pulse signals Vo1 and Vo2 from the two output terminals 143 and 144 at the substantially same timing (strictly speaking, the pulse signal Vo1 is outputted slightly later than the pulse signal Vo1, as shown in FIG. 3).

When the drive circuit 13 receives the pulse signal Vo1 from the second output terminal 144 while the drive circuit 13 does not operate the second switching device Q2, the drive circuit 13 identifies the rated current based on the amplitude of the pulse signal Vo1, sets the identified rated current to the target current of the constant current control, and starts operating the second switching device Q2 (as shown at each of time points t2 and t4 of FIG. 3). When the drive circuit 13 receives the pulse signal Vo1 from the first output terminal 143 while the drive circuit 13 operates the second switching device Q2, the drive circuit 13 stops operating the second switching device Q2 and then keeps the second switching device Q2 in off-state (as shown at a time point t3 of FIG. 3).

Accordingly, even if a light source device 2 is detached from the lighting device 1 under a condition where a light source 20 of the light source device 2 is powered, the second switching device Q2 can be stopped operating because all of the identifying terminals 313 are in floating state. As a result, the output voltage of the power supply circuit 10 can be reduced. Accordingly, the lighting device 1 has an improved safety in comparison with a case where an output voltage of a power supply circuit 10 (namely, a voltage across power feed terminals 311 and 312) is not reduced when a light source device 2 is detached.

Note that a pulse signal Vo1 may not be outputted from the first output terminal 143 when a light source device 2 is connected (i.e., at each of time points t2 and t4 of FIG. 3). In a case where the above described technical feature is combined with a known technique such as a dimming control according to an external signal or a constant illuminance control, the target current may be appropriately set smaller than the identified rated current. In an alternative example, a rated current may be represented, not by the amplitude (voltage value) of the pulse signal Vo1, but a width of a pulse signal Vo1 or the number of pulse signals.

According to the above structure, a rated current can be identified (determined) based on the detection result whether the identifying terminals 313 are in floating state or not, which is less susceptive to the temperature fluctuation and noise, and accordingly it is possible to suppress occurrence of wrong identification of the connected light source device 2 in comparison with a case where a rated current of a light source device 2 is identified using an impedance in the light source device 2.

Besides, if the lighting device 1 includes only one identifying terminal 313, the lighting device 1 can identify only two kinds of rated currents based on a detection result whether or not a notifying terminal 323 is connected to the identifying terminal 313. Also, in this case, the lighting device 1 cannot detect a state where no light source device 2 is connected to the lighting device 1 (hereinafter, referred to "a no-loaded state") based on the identifying terminal 313.

In contrast, in the embodiment, the lighting device 1 includes two identifying terminals 3131 and 3132, and accordingly it is possible to detect the no-loaded state when all of the identifying terminals 3131 and 3132 are in floating state. Moreover, it is possible to identify three kinds of rated currents.

The number of identifying terminals 313 is not limited to one or two, and may be three or more. In a case where the number of identifying terminals 313 is "n" and the lighting device 1 is configured to detect the no-laded state when all of the identifying terminals 313 are in floating state, "$2^n-1$" kinds of rated currents can be identified using the identifying terminals 313.

Note that, one (for example, an identifying terminal 3132 shown in a lower side of FIG. 1) of two or more identifying terminals 313 may be provided exclusively for detecting the no-loaded state. In this structure, each of the light source devices 2 includes at least one notifying terminal 323(3232) that is configured to come into contact with and make electrical connection with the identifying terminal 3132, regardless of the rated currents of the light sources 20.

As described above, the lighting device 1 of the embodiment is configured to detect the no-loaded state using the identifying terminal 313. That is, the control circuit 14 of the lighting device 1 is configured to detect the no-loaded state when all of the identifying terminals 313 are in floating state, and then stop the power supply circuit 10 from outputting electric power. Accordingly, the lighting device 1 of the embodiment has a simple circuit structure compared with a case where a circuit dedicated for detection of a no-loaded state is provided.

The drive circuit 13 may be configured to measure the output voltage of the buck converter 12, to judge whether the measured voltage is within a predetermined normal range or not, and to stop operating the second switching device Q2 if the measured output voltage of the buck converter 12 is out of the normal range. In this structure, at least one of upper and lower limits of the normal range may differ in accordance with a rated current of a light source 20 of a light source device 2.

Figure 4:
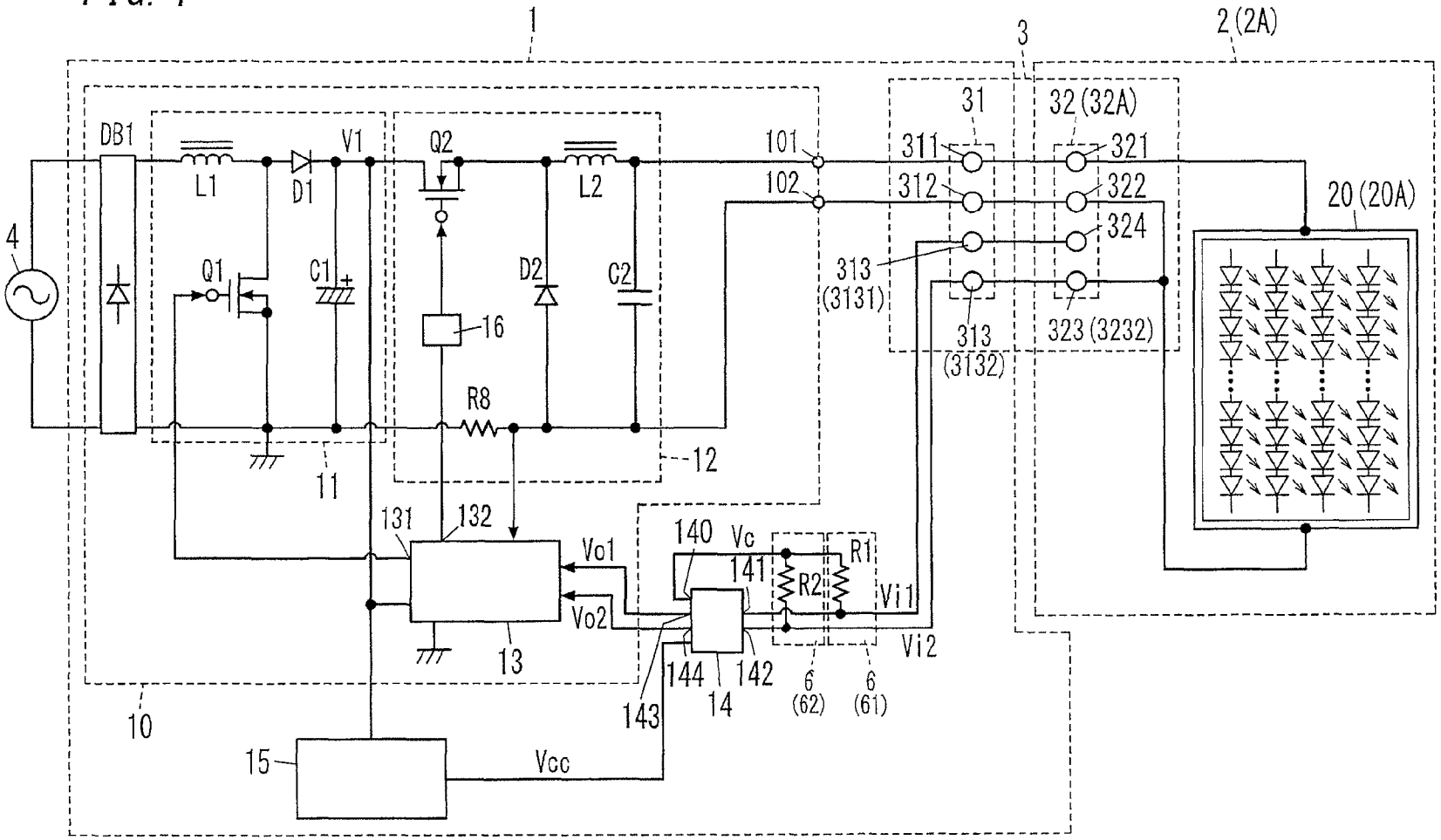
FIG. 4 is a circuit diagram of a lighting device and a light source device according to another embodiment.

The circuit structure of lighting device 1 is not limited to that shown in FIG. 1, but may be that shown in FIG. 4.

In a buck converter 12 of the example shown in FIG. 4, a first end (a drain) of a second switching device Q2 is electrically connected to a high potential side output end of a boost converter 11, a second end (a source) of the second switching device Q2 is electrically connected to a cathode of a second diode D2, and an anode of the second diode D2 is electrically connected to a low potential side output end of the boost converter 11 via a resistor R8. In the buck converter 12 of the example of FIG. 4, in order to increase a voltage at a second output terminal 132 of a drive circuit 13 to a high side, a high-side gate driver 16 is interposed between the second output terminal 132 and a control end (a gate) of the second switching device Q2. In the buck converter 12 of the example of FIG. 4, a series circuit of a second inductor L2 and a second output capacitor C2 is connected between both ends of the second diode D2. In the example of FIG. 4, the second inductor L2 is electrically connected to the cathode (i.e., a high potential side) of the second diode D2. Therefore, a low potential side output end of the buck converter 12 and also a second power feed terminal 312, which is at a low potential side, are substantially grounded. Also, a lighting device 1 of the example of FIG. 4 does not include the resistors R9 and R10, which are connected to the output ends of the buck converter 12 of the example of FIG. 1. The lighting device 1 of the example of FIG. 4 does not include the transistors Tr1 and Tr2, and the resistors R3 and R4 connected to the respective bases of the transistors Tr1 and Tr2. Also, identifying terminals 3131 and 3132 are electrically connected directly to respective input terminal 141 and 142 of a control circuit 14.

In the lighting device 1 of the example of FIG. 4, since the second power feed terminal 312 configured to be connected to an identifying terminal 313 via a light source device 2 is substantially grounded, the lighting device 1 has a simple circuit structure (for example, it does not include the resistors R9 and R10 and the like) in comparison with the example of FIG. 1.

The lighting device 1 of the example of FIG. 4 also includes at least one potential change detection circuit 6 (61 and 62) electrically connected individually to an identifying terminal 313 and configured to detect a change in potential at a corresponding identifying terminal 313. In this example, the potential change detection circuit 6 includes a resistor R1 (R2), and is configured to compare a potential at a corresponding identifying terminal 313 with a threshold (a potential difference between the constant voltage terminal 140 and an input terminal 141 (142)), and to notify the control circuit 14 of the change in the result of the comparison (i.e., change in potential at the identifying terminal 313).

Figure 5:
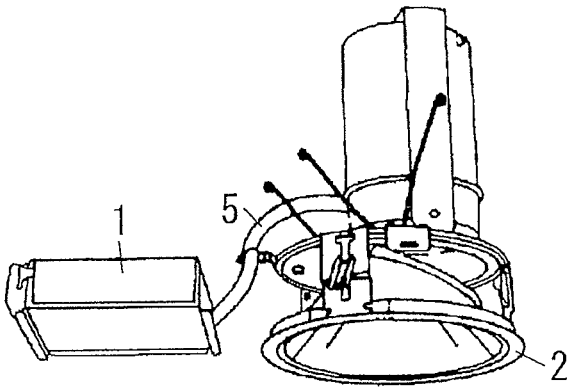
FIG. 5 is a perspective view of an example of a luminaire.

FIG. 5 shows an appearance of an example of a luminaire composed of a lighting device 1 and a light source device 2. In the example of FIG. 5, the lighting device 1 and the light source device 2 are electrically connected via a cable(s) 5. Aforementioned connector pair 3 may be provided: at the lighting device 1 and an end of a cable 5 pulled out from the light source device 2 (i.e., a supply side connector 31 is provided in the lighting device 1, and a load side connector 32 is provided at an end of a cable 5 pulled out from each light source device 2); or at the light source device 2 and an end of a cable 5 pulled out from the lighting device 1 (i.e., a supply side connector 31 is provided at an end of a cable 5 pulled out from the lighting device 1, and a load side connector 32 is provided in each light source device 2); or at ends of cables 5 pulled out from the lighting device 1 and the light source device 2 (i.e., a supply side connector 31 is provided at an end of a cable 5 pulled out from the lighting device 1, and a load side connector 32 is provided at an end of a cable 5 pulled out from each light source device 2).

However, the connector pair 3 is preferably provided at the lighting device 1 and the end of the cable 5 pulled out from the light source device 2. The reason is that: a cable 5 pulled out from the lighting device 1 should include many electric wires (not shown) that includes electric wires connected to the identifying terminal(s) 313 and two electric wires connected to power feed terminals 311 and 312 (e.g., the example of FIG. 1 needs four electric wires); on the contrary, a cable 5 pulled out from the light source device 2 can include only two electric wires (not shown), because a notifying terminal(s) 323 and a second power receiving terminal 322 are in the same potential and can be connected to the same electric wire.

As described above, the lighting device (1) of the embodiment is configured to be connected to a light source device (2) selected from the predetermined two or more light source devices (2). The lighting device (1) includes: the first and second power feed terminals (311 and 312) between which a light source (20) of each light source device (2) is configured to be electrically connected; the power supply circuit (10) that has high potential side and low potential side output ends (101 and 102) electrically connected respectively to the first and second power feed terminals (311 and 312) and is configured to output a DC power across the first and second power feed terminals (311 and 312) through the high potential side and low potential side output ends (101 and 102); the control circuit (14) configured to control the power supply circuit (10); and at least one identifying terminal (313) for identifying a rated current of a light source (20) of each light source device (2). The control circuit (14) is configured to identify a rated current of a light source (20) connected between the first and second power feed terminals (311 and 312) by detecting whether the identifying terminal (313) is in floating state or not, and to control the power supply circuit (10) so as to supply a current corresponding to the identified rated current to the light source (20) through the first and second power feed terminals (311 and 312).

In one embodiment, the lighting device (1) includes the potential change detecting circuit (6) electrically connected to the identifying terminal (313) and configured to detect a change in potential at the identifying terminal (313). The control circuit (14) is configured to detect whether the identifying terminal (313) is in floating state or not based on the change in potential at the identifying terminal (313) detected with the potential change detecting circuit (6).

In one embodiment, the at least one identifying terminal (313) includes the first identifying terminal (3131) and the second identifying terminal (3132). The control circuit (14) is configured to identify a rated current of the light source (2) connected between the first and second power feed terminals (311 and 312) in accordance with a combination of detection results about whether the first identifying terminal (3131) is in floating state or not and whether the second identifying terminal (3132) is in floating state or not.

In one embodiment, the lighting circuit (1) includes the first potential change detecting circuit (61) electrically connected to the first identifying terminal (3131) and configured to detect a change in potential at the first identifying terminal (3131); and the second potential change detecting circuit (62) electrically connected to the second identifying terminal (3132) and configured to detect a change in potential at the second identifying terminal (3132). The control circuit (14) is configured to: detect whether the first identifying terminal (3131) is in floating state or not based on the change in potential at the first identifying terminal (3131) detected with the first potential change detecting circuit (61); and detect whether the second identifying terminal (3132) is in floating state or not based on the change in potential at the second identifying terminal (3132) detected with the second potential change detecting circuit (62).

In one embodiment, the second power feed terminal (312) is substantially grounded.

The lighting system of the embodiment includes the lighting device (1) and the two or more light source devices (2) configured to be selectively connected to the lighting device (1). The two or more light source devices (2) includes at least a first light source device (2A) and a second light source device (2B). Each of the first light source device (2A) and the second light source (2B) includes: a first power receiving terminal (321) configured to be electrically connected to the first power feed terminal (311); a second power receiving terminal (322) configured to be electrically connected to the second power feed terminal (312); and a light source (20) electrically connected between the first and second power receiving terminals (321 and 322). A rated current of a light source (20A) of the first light source device (2A) is different from a rated current of a light source (20B) of the second light source (2B). The identifying terminal (313) of the lighting device (1) includes first and second identifying terminals (3131 and 3132). The second light source device (2B) includes first and second notifying terminals (3231 and 3232), where the first notifying terminal (3231) is electrically connected to its (2B) own second power receiving terminal (322) and configured to be electrically connected to the first identifying terminal (3131) of the lighting device (1), and the second notifying terminal (3232) is electrically connected to its (2B) own second power receiving terminal (322) and configured to be electrically connected to the second identifying terminal (3132) of the lighting device (1). The first light source device (2A) includes a second notifying terminal (3232) electrically connected to its (2A) own second power receiving terminal (322) and configured to be electrically connected to the second identifying terminal (3132) of the lighting device (1) (and does not include a first notifying terminal (3231)). The control circuit (14) of the lighting device (1) is configured to detect that the first identifying terminal (3131) is not in floating state when the first identifying terminal (3131) is electrically connected to a first notifying terminal (3231), and to detect that the second identifying terminal (3132) is not in floating state when the second identifying terminal (3132) is electrically connected to a second notifying terminal (3232). The control circuit (14) of the lighting device (1) is configured to identify a rated current of the light source (20) connected between the first and second power feed terminals (311 and 322) in accordance with a combination of detection results about whether the first identifying terminal (3131) is in floating state or not and whether the second identifying terminal (3132) is in floating state or not.

For example, the control circuit (14) of the lighting device (1) is configured to control the power supply circuit (10) so as to supply a current corresponding to a rated current of the light source (20B) of the second light source device (2B) through the first and second power feeding terminals (311 and 312) when the first and second identifying terminals (3131 and 3132) are not in floating state, and to control the power supply circuit (10) so as to supply a current corresponding to a rated current of the light source (20A) of the first light source device (2A) through the first and second power feeding terminals (311 and 312) when the first identifying terminal (3131) is in floating state and the second identifying terminal (3132) is not in floating state.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device configured to be connected to a light source device selected from predetermined two or more light source devices, the lighting device comprising:

first and second power feed terminals between which a light source of each light source device is configured to be electrically connected;

a power supply circuit that has high potential side and low potential side output ends electrically connected respectively to the first and second power feed terminals and is configured to output a DC power across the first and second power feed terminals through the high potential side and low potential side output ends;

a control circuit configured to control the power supply circuit; and at least one identifying terminal for identifying a rated current of a light source of each light source device, wherein the control circuit is configured to identify a rated current of a light source connected between the first and second power feed terminals by detecting whether the identifying terminal is in floating state or not, and to control the power supply circuit so as to supply a current corresponding to the identified rated current to the light source through the first and second power feed terminals.

2. The lighting device according to claim 1, further comprising a potential change detecting circuit electrically connected to the identifying terminal and configured to detect a change in potential at the identifying terminal, wherein the control circuit is configured to detect whether the identifying terminal is in floating state or not based on the change in potential at the identifying terminal detected with the potential change detecting circuit.

3. The lighting device according to claim 1, wherein the at least one identifying terminal comprises a first identifying terminal and a second identifying terminal, the control circuit is configured to identify a rated current of the light source connected between the first and second power feed terminals in accordance with a combination of detection results about whether the first identifying terminal is in floating state or not and whether the second identifying terminal is in floating state or not.

4. The lighting device according to claim 3, further comprising:

a first potential change detecting circuit electrically connected to the first identifying terminal and configured to detect a change in potential at the first identifying terminal; and a second potential change detecting circuit electrically connected to the second identifying terminal and configured to detect a change in potential at the second identifying terminal, wherein the control circuit is configured to: detect whether the first identifying terminal is in floating state or not based on the change in potential at the first identifying terminal detected with the first potential change detecting circuit; and detect whether the second identifying terminal is in floating state or not based on the change in potential at the second identifying terminal detected with the second potential change detecting circuit.

5. The lighting device according to claim 1, wherein the second power feed terminal is substantially grounded.

6. A lighting system comprising:

the lighting device according to claim 1; and the two or more light source devices configured to be selectively connected to the lighting device, wherein the two or more light source devices comprises at least a first light source device and a second light source device, each of the first and second light source devices comprises:

a first power receiving terminal configured to be electrically connected to the first power feed terminal;

a second power receiving terminal configured to be electrically connected to the second power feed terminal; and a light source electrically connected between the first and second power receiving terminals, a rated current of a light source of the first light source device is different from a rated current of a light source of the second light source, the identifying terminal of the lighting device comprises first and second identifying terminals, the second light source device comprises first and second notifying terminals, the first notifying terminal being electrically connected to its own second power receiving terminal and configured to be electrically connected to the first identifying terminal of the lighting device, the second notifying terminal being electrically connected to its own second power receiving terminal and configured to be electrically connected to the second identifying terminal of the lighting device, the first light source device comprises a second notifying terminal electrically connected to its own second power receiving terminal and configured to be electrically connected to the second identifying terminal of the lighting device, the control circuit of the lighting device is configured to detect that the first identifying terminal is not in floating state when the first identifying terminal is electrically connected to a first notifying terminal, and to detect that the second identifying terminal is not in floating state when the second identifying terminal is electrically connected to a second notifying terminal, and the control circuit of the lighting device is configured to identify a rated current of the light source connected between the first and second power feed terminals in accordance with a combination of detection results about whether the first identifying terminal is in floating state or not and whether the second identifying terminal is in floating state or not.

* * * * *